US005711096A

United States Patent [19]

Kobayashi et al.

[11] Patent Number: 5,711,096

[45] Date of Patent: Jan. 27, 1998

[54] WORKING MACHINE OF A HYDRAULIC BACKHOE HAVING INCREASED BLADE TIP FORCE

[75] Inventors: Takeshi Kobayashi, Hirakata; Haruo Tomozaki, Kurume; Yuji Shiomoto, Osaka; Tadashi Ekawa, Hirakata; Kiyoshi Sugiyama, Kanazawa, all of Japan

[73] Assignee: Komatsu Ltd., Tokyo, Japan

[21] Appl. No.: 628,631

[22] PCT Filed: Oct. 27, 1994

[86] PCT No.: PCT/JP94/01808

§ 371 Date: Aug. 6, 1996

§ 102(e) Date: Aug. 6, 1996

[87] PCT Pub. No.: WO95/12039

PCT Pub. Date: May 4, 1995

[30] Foreign Application Priority Data

Oct. 27, 1993 [JP] Japan ..... 5-062547
Oct. 27, 1993 [JP] Japan ..... 5-291236

[51] Int. Cl.[6] ..... E02F 3/32

[52] U.S. Cl. ..... 37/443; 37/466; 414/694

[58] Field of Search ..... 37/443, 444, 411, 37/403, 468, 466; 414/685, 694, 695.5, 723, 707, 715

[56] References Cited

U.S. PATENT DOCUMENTS

| | | | |
|---|---|---|---|
| 3,807,589 | 4/1974 | Shovick | 37/444 X |
| 4,077,140 | 3/1978 | Branconi | 37/443 |
| 4,277,899 | 7/1981 | Guthoff | 37/443 |
| 4,314,789 | 2/1982 | Luigi | 37/444 X |
| 4,677,772 | 7/1987 | Morelli | 37/443 |
| 5,088,213 | 2/1992 | Raimondo et al. | 37/443 X |
| 5,497,568 | 3/1996 | Strickland | 37/348 |
| 5,507,107 | 4/1996 | Pinomaki | 37/443 X |
| 5,535,533 | 7/1996 | Romanchok | 37/403 |

FOREIGN PATENT DOCUMENTS

| | | |
|---|---|---|
| 50-20503 | 3/1975 | Japan . |
| 62-190748 | 12/1987 | Japan . |
| 4-15637 | 2/1992 | Japan . |

*Primary Examiner*—Terry Lee Melius
*Assistant Examiner*—Victor Batson
*Attorney, Agent, or Firm*—Armstrong, Westerman, Hattori, McLeland & Naughton

[57] ABSTRACT

The invention provides a working machine of a hydraulic backhoe in which the blade tip force can be increased over a wide range of operations, which has a great blade tip force at the start of excavation, and which can increase working efficiency by avoiding obstacles. For these purposes, a second link pivotally connected to third fulcrums (6, 13) provided in common at a leading end of an arm cylinder (4) and one end of a first link (10) and to a second fulcrum (12) of an arm (2) is a hydraulic correction cylinder (11). A working hydraulic circuit for the arm cylinder (4) and the correction cylinder (11) may constitute a series circuit having a circuit (24) connecting a head side oil chamber (20) of the arm cylinder (4) to a bottom side oil chamber (23) of the correction cylinder (11).

7 Claims, 13 Drawing Sheets

WORKING MACHINE OF A HYDRAULIC BACKHOE HAVING INCREASED BLADE TIP FORCE

TECHNICAL FIELD

The present invention relates to a working machine of a hydraulic backhoe, and more particularly to a backhoe type working machine of a hydraulic shovel for use in excavation and other works.

BACKGROUND ART

Heretofore, as shown in FIG. 18, a hydraulic backhoe 50 has a bucket 7 as one kind of working member which is attached to a leading end of an arm 2. When starting work such as excavation, an arm rotational angle θ with respect to a boom 1 is maximized so that a-blade tip 8 of the bucket 7 has a greater maximum working height H. The blade tip force produced by the hydraulic backhoe 50 when the arm 2 rotates will now be described with reference to FIGS. 19 and 20. A working machine 53 comprises a boom 1, an arm 2, a bucket 7, an arm cylinder 4, and so on. Assuming that the distance from a pin 3 to a leading end of the bucket 7 is R, the distance from the pin 3 to a pin 6 is r, the thrust of the arm cylinder 4 is $F_O$, and the length of a vertical line from the pin 3 to a center axis of the arm cylinder 4 (the radius of moment of rotation) is L, the blade tip force $F_E$ of the bucket 7 produced upon extension of the arm cylinder 4 while the boom 1 is kept not swung is expressed by:

$$F_E=(L\times F_O)/R \quad (1)$$

Also, because of $L_{max}=r$, the maximum blade tip force $F_{Emax}$ is expressed by:

$$F_E=(L\times F_O)/R \quad (1)$$

The rotational angle of the arm 2 at which the maximum blade tip force $F_{Emax}$ is produced, i.e., the angle through which the arm 2 rotates from a position corresponding to the minimum stroke of the arm cylinder 4 to a position corresponding to the radius $L_{max}$ of maximum moment of rotation is assumed to be φ. In a graph of FIG. 22, a curve Q represents the relationship between the blade tip force $F_E$ and the arm rotational angle θ with the horizontal axis representing the arm rotational angle θ and the vertical axis representing the blade tip force $F_E$ of the bucket 7. At θ=φ (point Qb), the blade tip force $F_E$ is maximized. On the other hand, the start of excavation (θ4) where the arm rotational angle θ is large corresponds to the position of a point Qa, and the end of excavation (θ2) where the arm rotational angle θ is small corresponds to the position of a point Qc. At either point, the blade tip force $F_E$ is reduced to a large extent.

However, because the working machine 53 of the above structure comprises three articulated members, i.e., the boom 1, the arm 2 and the arm cylinder 4, there is a problem that the rotational angle of the arm 2 is necessarily restricted and the excavation force and the working range are both not sufficient at a maximum working reach. To improve working efficiency of a hydraulic backhoe at its maximum working reach, therefore, it is required to increase the arm rotational angle θ and enlarge the working range from E0 to E1 as shown in FIG. 22. It is also required to increase the blade tip force $F_E$ on the angular side giving a higher arm level (namely at the arm rotational angle θ4) where the excavation is started with the maximum working reach, i.e., the blade tip force $F_E$ at the point Qa on the curve Q. Furthermore, while the blade tip force $F_E$ is maximized (at the point Qb) at the arm rotational angle θ being equal to φ, the blade tip force $F_E$ at the point Qc (namely the arm rotational angle θ2) on the angular side giving a lower arm level where the excavation is ended requires that it will not reduce abruptly.

As another prior art, there is known a working machine wherein an arm and a boom are coupled to each other by a 4-articulated-link mechanism as shown in FIG. 23 (see, e.g., Japanese Utility Model Laid-Open No. 4-15637). A boom 1 of this working machine has a pin 43 as a first fulcrum provided at its leading end and a pin 46 as a fourth fulcrum provided near the leading end. The boom 1 is coupled at the pin 43 to one end of an arm 2 and at the pin 46 to one end of a first link 42. Also, an arm cylinder 4 is coupled to the other end of the first link 42 through a pin 45 as a third fulcrum. A pin 44 as a second fulcrum is provided at another end of the arm 2 on the same side as but different from one end thereof. Further, a second link 41 has one end coupled to the pin 44 and the other end coupled to the pin 45. With such a construction, when the arm 2 is folded into the bosom of the boom 1, an angle θA formed between the boom 1 and the arm 2 can be made small. As a result, it is possible to reduce the height of the boom 1 and to transport an attachment (working member) **7*c*** having a large overall height while it remains mounted in place.

However, since the above working machine having such a 4-articulated-link mechanism intends to improve transporting efficiency, it is not able to enlarge a range of the arm rotational angle on the side giving a higher arm level to thereby improve working efficiency at the maximum working reach and increase the blade tip force.

The operation of a prior art hydraulic backhoe in waterworks will be described with reference to FIG. 24. A vehicle body 51 has a bracket 61 attached thereto through a pin 62, and a boom 1 is attached to the bracket 61 through a pin 63. A leading end of the boom 1 is attached to an arm 2 through a pin 3. An arm cylinder 4 has a tailing end attached through a pin 5 to a bracket **1*b* fixed to the boom 1, and a leading end attached to the arm 2 through a pin 6. Further, a bucket 7 is attached to a leading end of the arm 2 through a pin 64. The angle formed between a line 90 (reference line) interconnecting the pin 63 and the pin 3 both used for attachment of the boom 1 and a line 93 interconnecting the pin 3 and the pin 64 is defined as an arm rotational angle θ. Within the arm rotational angle θ, the arm 2 is rotatable upon extension and contraction of the arm cylinder 4. In waterworks for burying water pipes around a house 81, a pipe burying hole 84 is dug in the underground 86 below a fence 82 and a gutter 83**.

In waterworks using the prior art hydraulic backhoe, however, the bucket 7 can be only rotated within the narrow arm rotational angle θ. Accordingly, when burying water pipes around the house 81, it is difficult to dig the pipe burying hole 84 in the underground 86 because the fence 82 and the gutter 83 are present as obstacles. Therefore, digging of the hole 84 must rely on human power, resulting in a problem of poor working efficiency. This raises a need of enlarging the working range of the arm 2 (i.e., the arm rotational angle θ) so that the arm 2 is allowed to turn upwardly for digging of the hole 84.

In FIG. 25 which shows conventional pull-down work, a breaker **7*a* (working member) is attached to the leading end of the arm 2 through the pin 64. When pulling down an office building or the like, a ceiling 87*a*, a pillar beam 87*b* and a wall 85*c* of the building are broken up by the breaker 7*a***.

As with the foregoing waterworks, however, because the breaker **7*a* can be only rotated within the narrow arm rotational angle θ, there arises a problem that the pillar beam 87*b***, etc. lying overhead become obstacles in the pull-down work, making it difficult to efficiently break up the building by the breaker 7a. This also raises a need of enlarging the working range of the arm 2 so that the arm 2 is allowed to turn upwardly for enabling the breaker to break up the building out of interference with obstacles.

DISCLOSURE OF THE INVENTION

The present invention has been made with a view of solving the above-stated problems in the prior art, and its object is to provide a working machine of a hydraulic backhoe in which the blade tip force of a bucket is large over the entire working range of an arm, which can increase the blade tip force particularly at an arm rotational angle on the side giving a higher arm level, i.e., at the start of excavation, and in which the arm can be turned upwardly to enlarge the working range.

A first aspect of the working machine of the hydraulic backhoe according to the present invention is featured in that one end of a first link is coupled to either a leading end of a boom or a portion of the boom on the rear side of the leading end, and a second link is a hydraulic correction cylinder. Also, a working hydraulic circuit for an arm cylinder and the correction cylinder may constitute a series circuit having a circuit connecting a head side oil chamber of the arm cylinder to a bottom side oil chamber of the correction cylinder. Further, a third fulcrum at which the other end of the first link and the arm cylinder are coupled to each other may comprise a fulcrum at which the arm cylinder and the first link are coupled to each other and a fulcrum at which the correction cylinder and the first link are coupled to each other, these two fulcrums being spaced a predetermined distance.

With such an arrangement, when the arm cylinder is operated to extend, the correction cylinder is also extended correspondingly. Therefore, an arm rotational angle can be increased even with a small rotational angle of the first link. As a result, the radius of moment of rotation is increased, whereby torque applied from the arm cylinder for rotating the arm is strengthened to increase the blade tip force. In addition, since the arm rotational angle can be increased, it is possible to enlarge the working range.

A second aspect of the invention is featured in that a ratio of the fulcrum-to-fulcrum distance between a first fulcrum and a second fulcrum, the pivot-to-pivot distance along a center axis of the second link, and the pivot-to-pivot distance along a center axis of the first link is approximately 2:2:3.

With such an arrangement, when the arm cylinder is operated to extend and contract, the arm is swung through a 4-articulated-link mechanism. Therefore, the arm rotating torque can be strengthened to increase the blade tip force, and the arm rotational angle can be increased to enlarge the working range.

A third aspect of the invention is featured in that a ratio of the fulcrum-to-fulcrum distance between said first fulcrum and said second fulcrum, the pivot-to-pivot distance along a center axis of said second link, and the pivot-to-pivot distance along a center axis of said first link is approximately 1:0.87:1.25.

With such an arrangement, the blade tip force is increased at the arm rotational angle on the side giving a higher arm level.

A fourth aspect of the invention is featured in that an arm rotational angle formed between a line interconnecting a pivot pin for coupling the boom to a bracket on the vehicle body and the first fulcrum, as a reference line, and a line interconnecting the first fulcrum and a pivot pin for coupling a working member to the arm is set to be not less than 180° in the clockwise direction from the reference line. Alternatively, the arm rotational angle through which the arm is rotatable about a pivot pin, as a fulcrum, for coupling the leading end of the boom to the arm may be set to be not more than 270°.

With such an arrangement, even when such works as burying water pipes or pulling down an office building, etc. are carried out in a place where there is an obstacle, the obstacle can be avoided by turning the arm upwardly, resulting in improved working efficiency. Furthermore, in such works as digging the underground below an obstacle with the boom turned downwardly beneath the ground surface, or pulling down an office building, etc. under situation that an overhead obstacle is suspended downwardly within the building in front of the backhoe, the obstacle can be avoided by increasing the arm rotational angle. As a result, it is possible to easily carry out the operation of digging a hole for burying water pipes therein, the operation of breaking up an office building with an overhead obstacle suspended downwardly therein, and so on.

BRIEF DESCRIPTION OF THE DRAWINGS

FIGS. 5A and 5B are views for comparing operations of working machines of a hydraulic backhoe in which; FIG. 5A is a side view of principal part of the prior art and FIG. 5B is a side view of principal part of the first embodiment.

BEST MODE FOR CARRYING OUT THE INVENTION

Hereinafter, preferred embodiments of a working machine of a hydraulic backhoe according to the present invention will be described with reference to the attached drawings.

Figure 1:
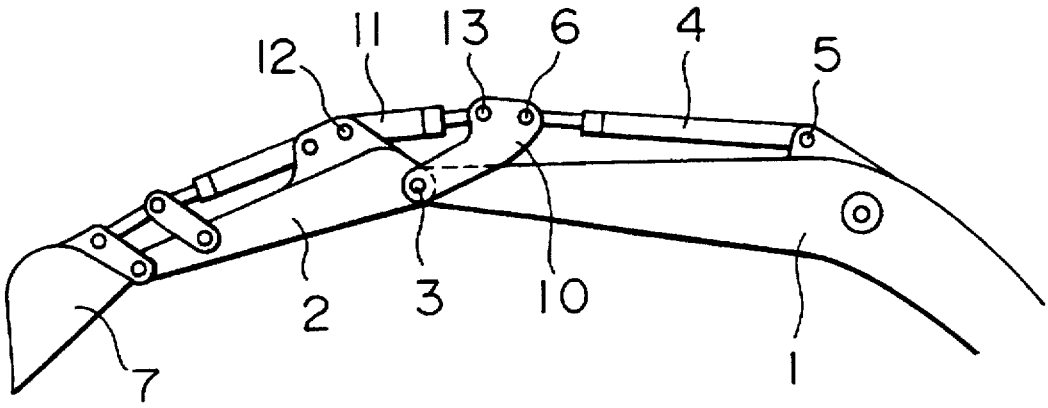
FIG. 1 is a side view of principal part of a working machine of a hydraulic backhoe according to a first embodiment of the present invention.
Figure 23:
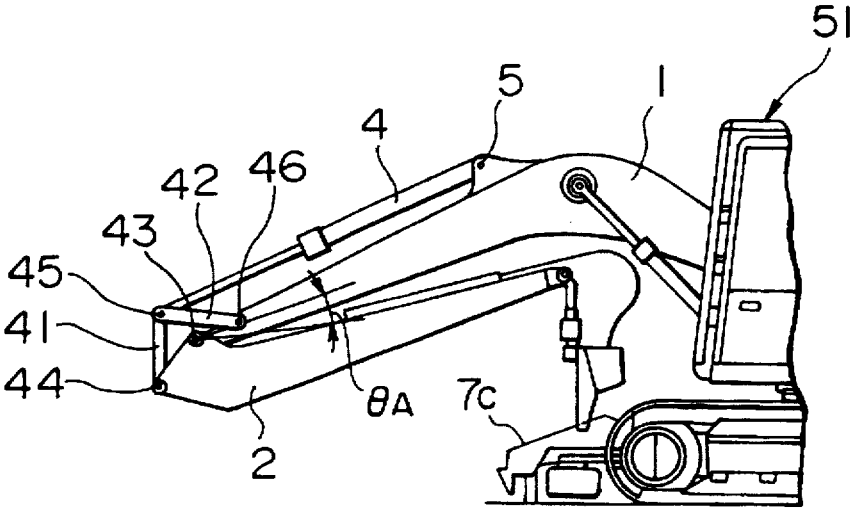
FIG. 23 PRIOR ART
FIG. 23 is a side view of a working machine of a hydraulic backhoe according to another prior art.

In FIG. 1 which shows principal part of a working machine of a first embodiment, a leading end of a boom 1 is coupled to one end of an arm 2 and one end of a first link 10 through a pin 3 as a first fulcrum. It is to be noted that, referring to FIG. 23 showing the prior art, the pin 3 corresponds to the pin 43 (first fulcrum) and the pin 46 (fourth fulcrum) in the case where the two pins would be provided at the same position. Accordingly, the pin 3 serves as not only the first fulcrum, but also the fourth fulcrum in FIG. 23. Further, another end of the arm 2 near but different from the first fulcrum (pin 3) is coupled to a tailing end of a correction cylinder 11 through a pin 12 as a second fulcrum, and a bucket 7 is pivotally attached to the leading end of the arm 2.

The correction cylinder 11 corresponds to the link 41 in FIG. 23. The other end of the first link 10 is coupled to a leading end of the correction cylinder 11 through a pin 13 and a leading end of the arm cylinder 4 through a pin 6. A tailing end of the arm cylinder 4 is coupled to the boom 1 through a pin 5 at a location on the side nearer to a vehicle body (not shown). While the pin 13 and the pin 6 serve as fulcrums in a link mechanism, these two pins may be provided at the same position. In this case, the pins 13, 6 correspond to the pin 45 in FIG. 23 and serve as a third fulcrum. Further, while the embodiment has been described as coupling one end of the first link 10 to the pin 3, a 4-articulated-link mechanism may be constituted by pivotally coupling one end of the first link 10 to the boom 1 at a location on the side nearer to the vehicle body (not shown) than the pin 3.

Figure 2:
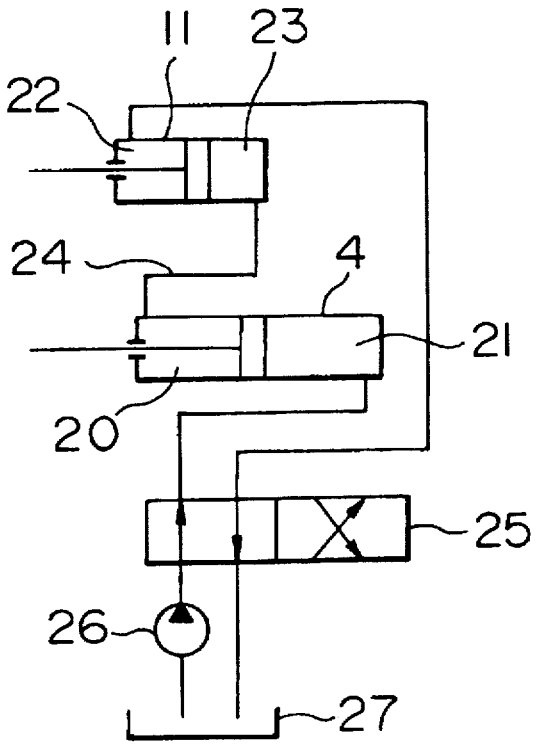
FIG. 2 is a hydraulic circuit diagram of principal part of the working machine of the first embodiment.

In FIG. 2 which shows a hydraulic circuit of this embodiment, a head side oil chamber 20 of the arm cylinder 4 and a bottom side oil chamber 21 of the correction cylinder 11 are connected to each other by a circuit 24. Also, a bottom side oil chamber 21 of the arm cylinder 4 and a head side oil chamber 22 of the correction cylinder 11 are selectively connected to a hydraulic pump 26 and an oil tank 27 through a selector valve 25. With such an arrangement, the hydraulic circuit constitutes a series circuit.

Figure 3:
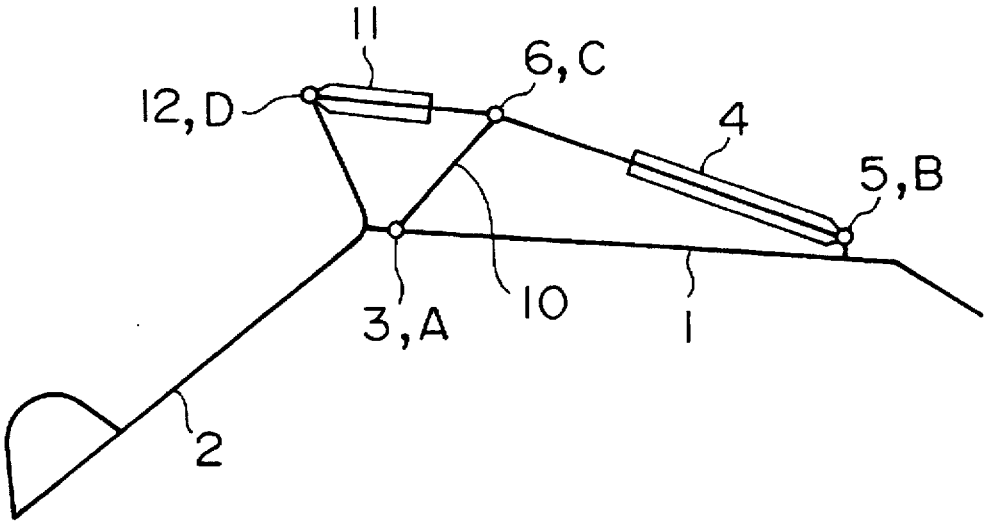
FIG. 3 is a schematic explanatory view of construction of the working machine of the first embodiment.
Figure 4:
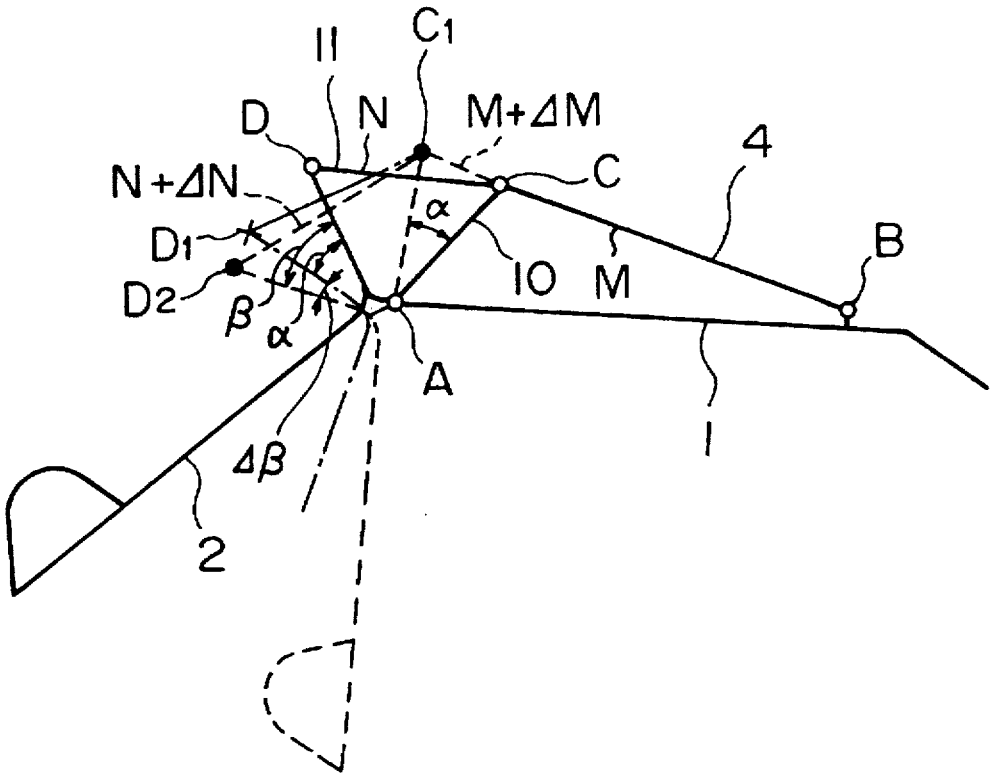
FIG. 4 is an explanatory view of operation of the working machine of FIG. 3.

The operation of the working machine thus constructed will be described with reference to FIGS. 3 and 4. FIG. 3 shows an example of the link mechanism in which both the positions of the pin 13 and the pin 6 agree with each other. Assuming now that the pin 3 is denoted by A, the pin 5 by B, and the pin 6 by C, A-B-C defines a closed triangle. Assuming the pin 12 to be denoted by D, A-C-D also defines a closed triangle. In the operation, as shown in FIG. 4, if the arm cylinder 4 of a length M is extended $\Delta M$ to have a length $M+\Delta M$, the first link 10 is turned an angle $\alpha$ correspondingly, whereupon the point C moves to a point $C_1$. At this time, if the correction cylinder 11 is not operated to extend and contract, the point D would move to a point $D_1$ corresponding to the movement of the point C and the arm 2 would be also turned $\alpha$.

Figure 20:
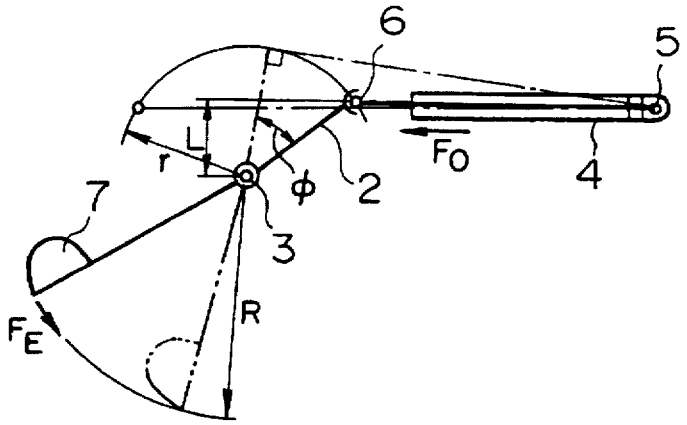
FIG. 20 PRIOR ART
FIG. 20 is a schematic explanatory view of operation of the working machine of FIG. 19.

However, since the arm cylinder 4 and the correction cylinder 11 constitute a series circuit as shown in FIG. 2, a length N of the correction cylinder 11 is extended $\Delta N$ into $N+\Delta N$ corresponding to the extension $\Delta M$ of the arm cylinder 4. Corresponding to the extension of the length N, the point $D_1$ moves to a point $D_2$. As a result, the arm 2 is further turned $\Delta\beta$ and the rotational angle of the arm 2 is given by $\alpha+\Delta\beta=\beta$. In other words, when the stroke of the arm cylinder 4 is changed $\Delta M$, the rotational angle of the first link 10 is $\alpha$, but the rotational angle of the arm 2 is $\beta(>\alpha)$. Thus, by using the correction cylinder 11 capable of extending and contracting, the rotational angle of the first link 10 determined depending on the extension and contraction of the arm cylinder 4 is converted to the rotational angle of the arm 2 after being amplified by the correction cylinder 11. Consequently, since a predetermined rotational angle of the arm 2 can be achieved with a smaller stroke of the arm cylinder 4 than required in the prior art shown in FIG. 20, the rotational angle of the first link 10 can be made smaller than the rotational angle of the arm 2.

Figure 5A:
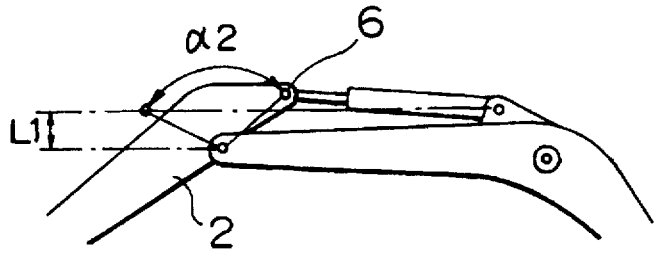
FIG.5A PRIOR ART
Figure 5B:
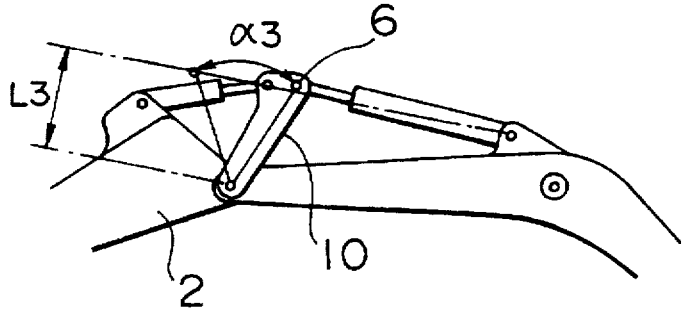

FIGS. 5A and 5B show respectively the operations of the prior art and this embodiment operate with respect to a difference in rotational angle. Given the rotational angle of the arm 2 to be $\alpha_2$ for each case, the arm 2 is rotated $\alpha_2$ in the prior art, whereas the rotational angle of the first link 10 is rotated $a_3$ in this embodiment smaller than $a_2$. This means that about the rotational angle $\phi$ (see FIG. 20) where the radius $L_{max}$ of maximum moment of rotation is provided, for example, a predetermined rotational angle of the arm can be achieved even with a smaller change in the rotational angle of the first link 10. Accordingly, the radius $L_3$ of moment of rotation in this embodiment becomes larger than the radius $L_1$ of moment of rotation in the prior art. Thus, as seen from the equation (1) stated above in connection with the prior art, the working machine of this embodiment can increase the blade tip force $F_E$.

Figure 6:
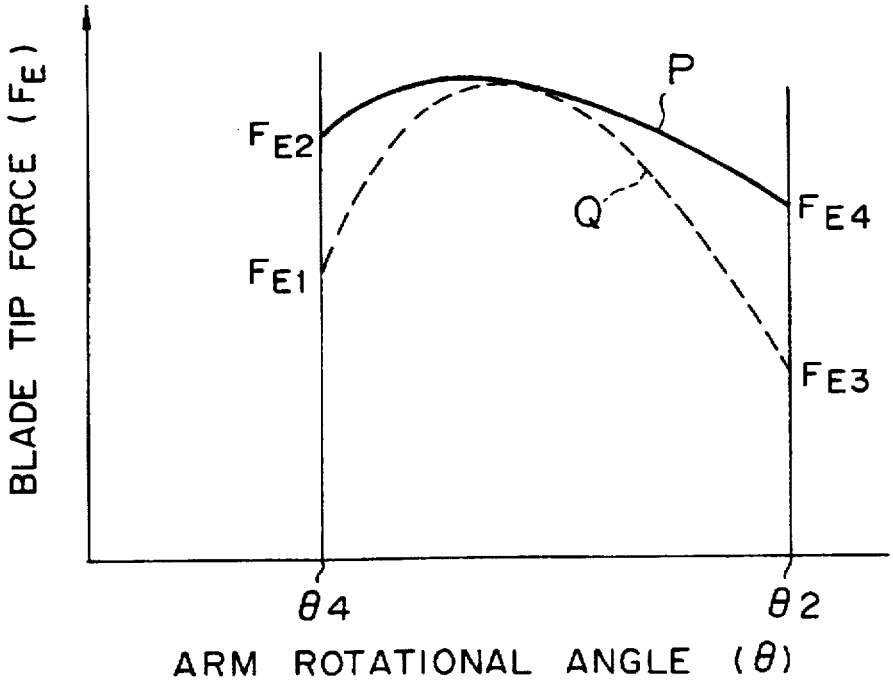
FIG. 6 is a graph showing characteristics of the blade tip forces of the working machines in the first embodiment and the prior art.
Figure 22:
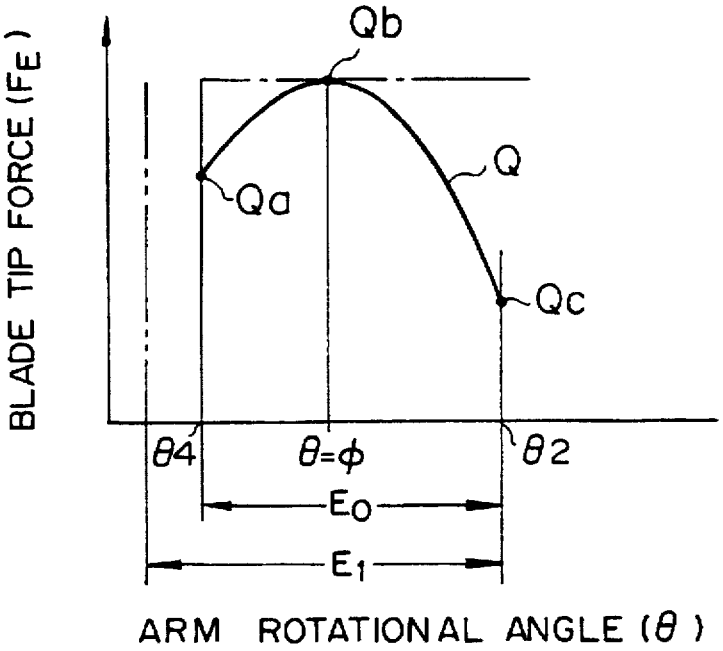
FIG. 22 PRIOR ART
FIG. 22 is a graph showing characteristics of the blade tip force of the working machines of FIG. 19.

In FIG. 6 which plots the blade tip force $F_E$, a curve P represents this embodiment and a curve Q represents the prior art. As will be apparent from FIG. 6, the blade tip force $F_E$ at the position of the arm rotational angle $\theta$ on the side giving a higher arm level when the bucket 7 starts the excavation is increased from $F_{E1}$ to $F_{E2}$, and the blade tip force $F_E$ at the position of the arm rotational angle $\theta$ on the side giving a lower arm level when the bucket 7 ends the excavation is increased from $F_{E3}$ to $F_{E4}$. It is therefore understood that the curve P comes closer to an ideal one-dot-chain line shown in FIG. 22 and the working machine of this embodiment is advantageous in practical use.

Figure 7:
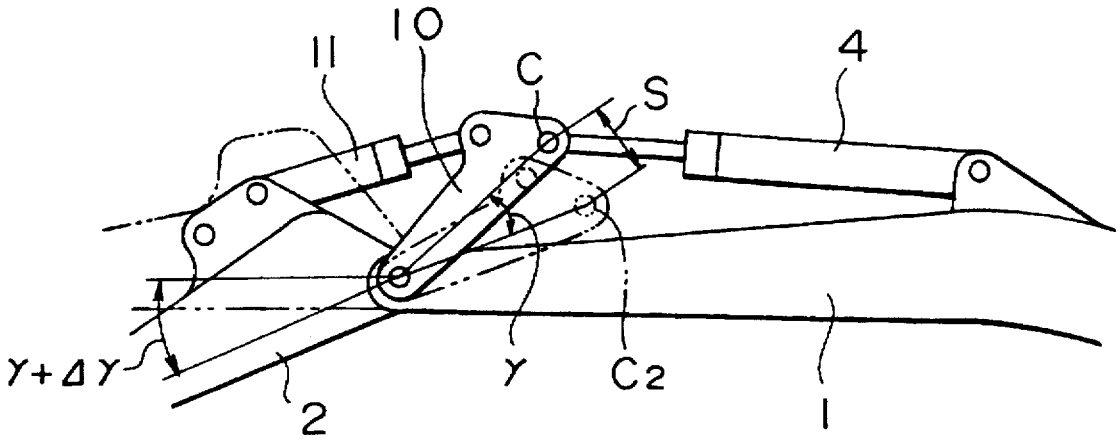
FIG. 7 is an explanatory view of operation of a first link in the working machine of the first embodiment.
Figure 8:
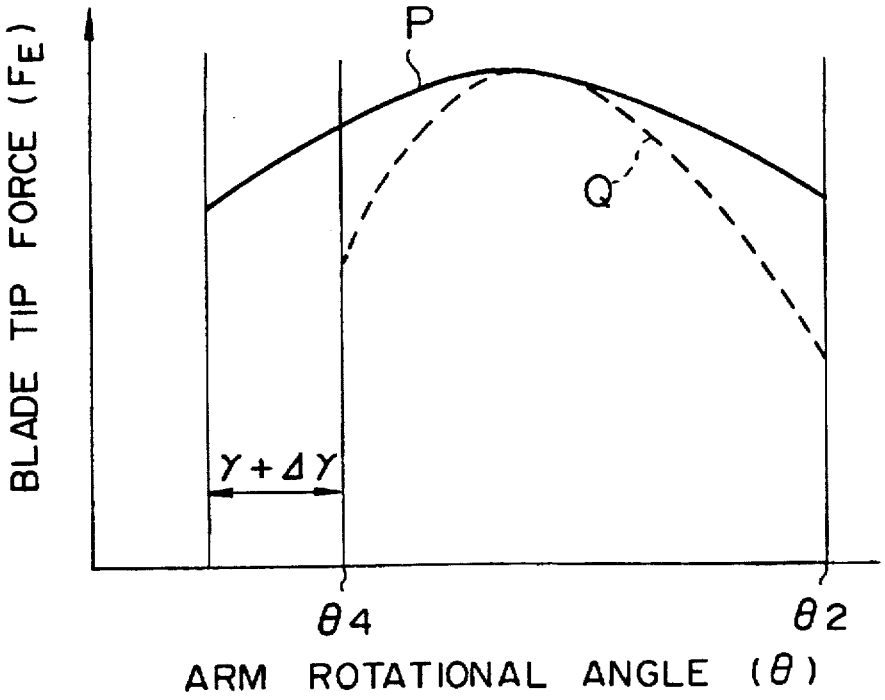
FIG. 8 is a graph showing arm rotational angles in the first embodiment and the prior art.
Figure 9:
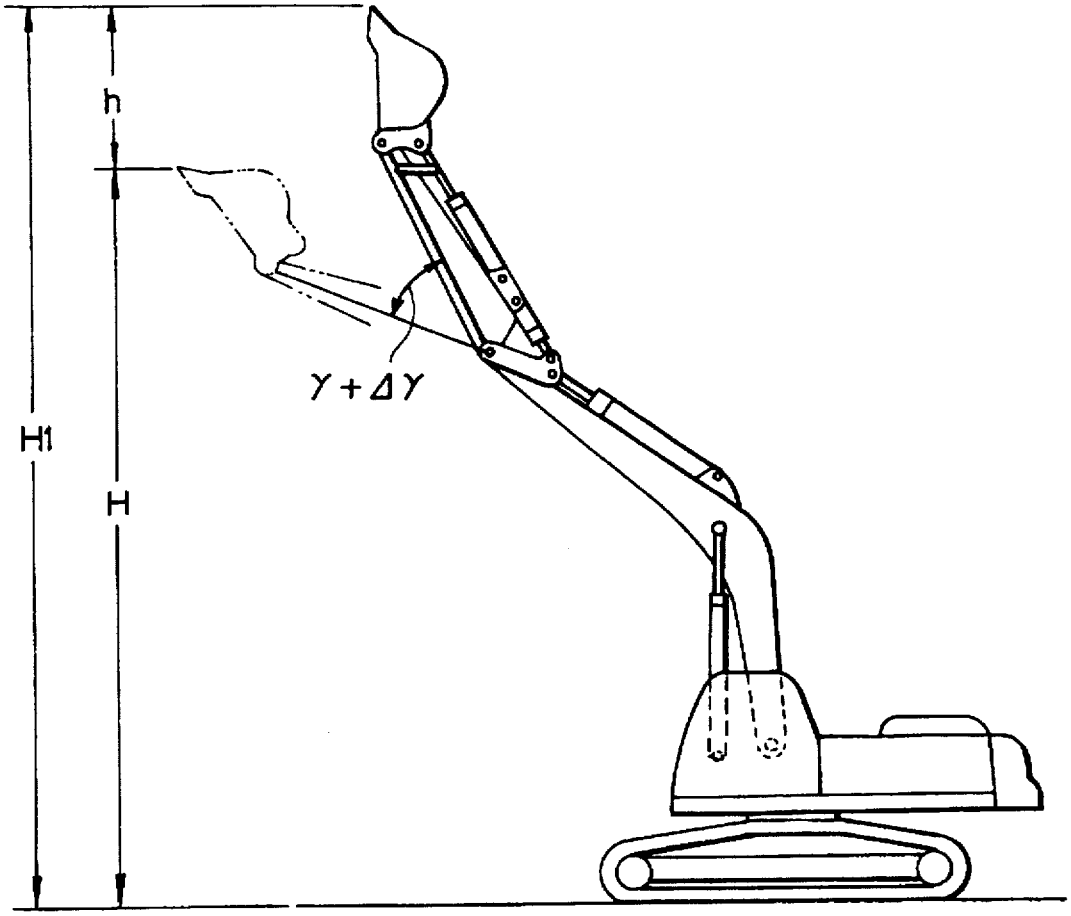
FIG. 9 is a view for explaining a working range of the hydraulic backhoe equipped with the working machine of the first embodiment.

The working range of this embodiment will be described below. As stated above, for the same arm rotational angle θ as in the prior art, the rotational angle of the first link 10 can be made smaller in this embodiment. Accordingly, as shown by solid lines in FIG. 7, even at the same position of an arm rotational angle θ4 on the side giving a higher arm level as in the prior art, there is still an allowance of distance S before an interference between the boom 1 and the first link 10. More specifically, by contracting the arm cylinder 4 so as to have a smaller stroke, the point C is moved to $C_2$ and the first link 10 is rotated an angle γ. At the same time, the stroke of the correction cylinder 11 is reduced and the arm 2 is additionally rotated an angle Δγ. The arm 2 is thus rotated γ+Δγ to the angular side giving a higher arm level. In other words, as shown in FIG. 8, this embodiment (curve P) can provide a larger maximum arm rotational angle than 84 in the prior art (curve Q) on the side of the arm rotational angle θ giving a higher arm level. As a result, as shown in FIG. 9, the working range $H_1$ of this embodiment is larger than the working range H of the prior art by h and the working efficiency is improved.

Next, a second embodiment of the working machine of the hydraulic backhoe according to the present invention will be described with reference to the drawings.

Figure 10:
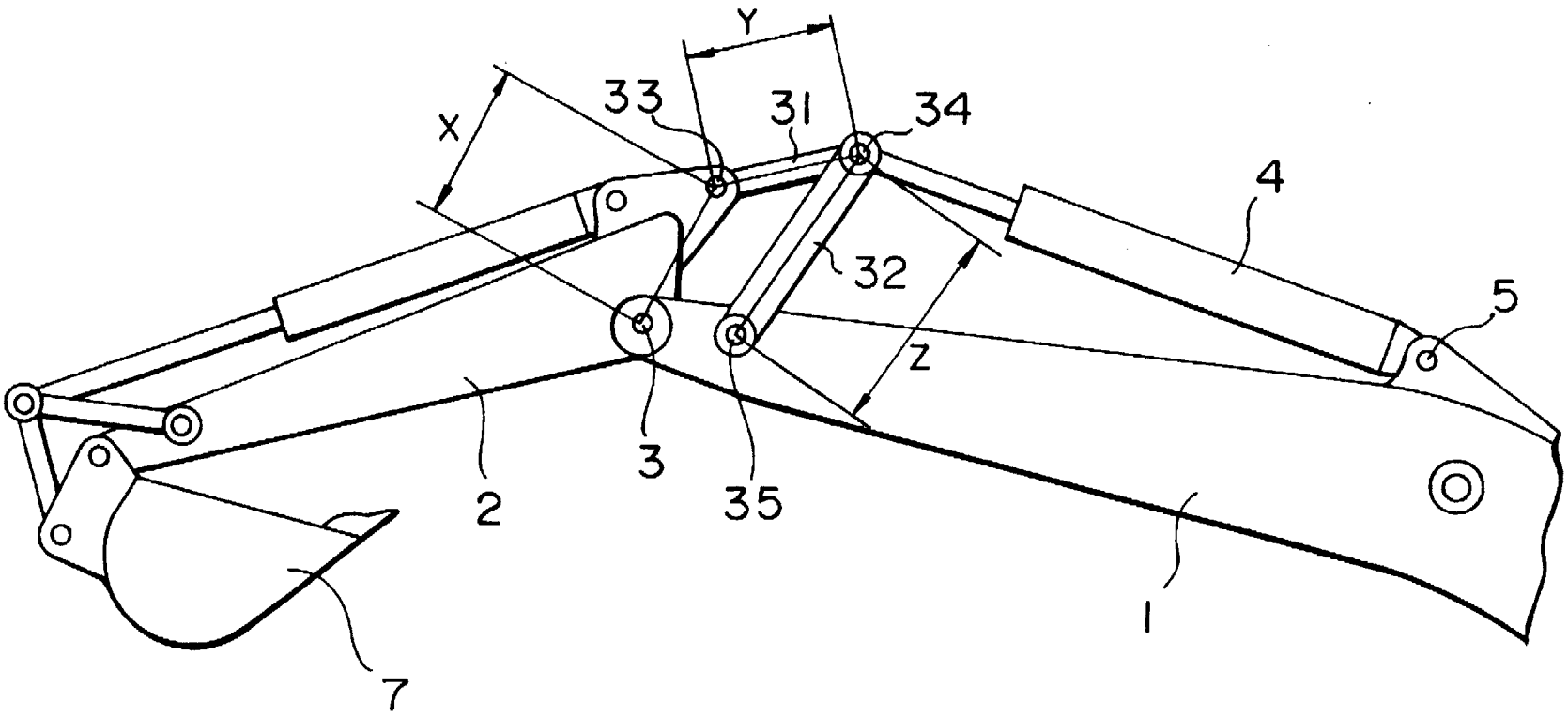
FIG. 10 is a side view of principal part of a working machine of a hydraulic backhoe according to a second embodiment of the present invention.

In FIG. 10, one end of an arm 2 is pivotally attached to a leading end of a boom 1 through a pin 3 as a first fulcrum. Also, the boom 1 is pivotally coupled to one end of the first link 10 through a pin 35 as a fourth fulcrum at a location on the side nearer to a vehicle body (not shown) than the pin 3. Another end of the arm 2, on the same side as the one end of the arm 2 which is pivotally attached to the leading end of the boom 1 through the pin 3 (first fulcrum) but different from the pin 3 (first fulcrum), is pivotally coupled to one end of a second link 31 through a pin 33 as a second fulcrum. The other end of the second link 31 and the other end of the first link 32 are coupled to a leading end of an arm cylinder 4 through a pin 34 as a third fulcrum. A tailing end of the arm cylinder 4 is pivotally coupled to the boom 1 through a pin 5. With such an arrangement, the arm 2 and the boom 1 are coupled to each other by a 4-articulated-link mechanism. Accordingly, when the arm cylinder 4 is operated to extend and contract, the arm 2 is rotated through the second link 31 and the first link 32.

Assuming that the fulcrum-to-fulcrum distance between the pin 3 (first fulcrum) and the pin 33 (second fulcrum) is X, the pivot-to-pivot distance between the pin 33 and the pin 34 (third fulcrum) along a center axis of the second link 31 is Y, and the pivot-to-pivot distance between the pin 34 and the pin 35 (fourth fulcrum) along a center axis of the first link 32 is Z, the ratio of X:Y:Z (link ratio) is approximately 2:2:3.

The above link ratio intends to, as compared with the characteristics of the blade tip force in the prior art (see FIG. 22), not only increase the maximum arm rotational angle θ4 at which the excavation is started, but also increase the blade tip force $F_E$. Thus, this embodiment is essentially different from the prior art working machine having the 4-articulated-link mechanism (see FIG. 23) which intends to reduce the angle θA formed between the boom 1 and the arm 2 for thereby enabling the attachment 7c to be transported while it remains mounted in place.

Figure 11:
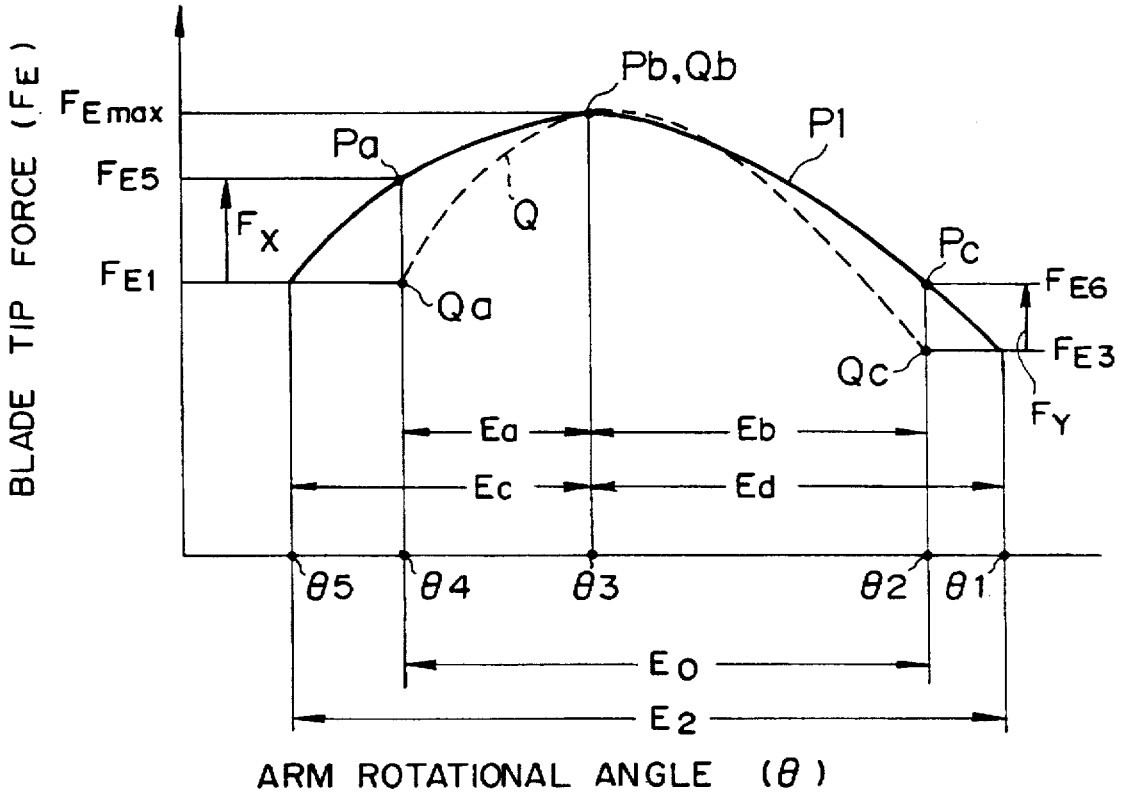
FIG. 11 is a graph showing characteristics of the blade tip forces of the working machines in the second embodiment and the prior art.

FIG. 11 is a graph showing the blade tip force $F_E$ over a range of the arm rotational angle θ in this embodiment (represented by a curve P1) having the link ratio set to be approximately 2:2:3. This embodiment is improved in the following points as compared with the prior art (represented by a curve Q).

(1) Assuming that the maximum blade tip force $F_{Emax}$ (point Pb on the curve P1) is 1, the blade tip force $F_E$5 (point Pa) at θ4, i.e., at the same start angle of excavation as in the prior art is 0.82. On the other hand, in the prior art, assuming that the maximum blade tip force $F_{Emax}$ (point Qa on the curve Q) is 1, the blade tip force $F_E$1 (point Qa) at the start of excavation is 0.57. Thus, the blade tip force at the start of excavation in this embodiment is increased to 0.82 from 0.57 in the prior art, i.e., about 45% (as represented by FX in FIG. 11). Further, on the angular side giving a higher arm level, the range of the arm rotational angle θ (within which at least the blade tip force $F_E$1 is obtained) is enlarged to Ec (θ3 to θ5) in this embodiment from Ea (θ3 to θ4) in the prior art, i.e., about 40%.

(2) Assuming that the maximum blade tip force $F_{Emax}$, is 1, the blade tip force $F_E$6 (point Pc on the curve P1) at the end of excavation is 0.45. On the other hand, in the prior art, assuming that the maximum blade tip force $F_E$ is 1, the blade tip force $F_E$3 (point Qc on the curve Q) at the end of excavation is 0.39. Thus, the blade tip force at the end of excavation in this embodiment is increased to 0.45 from 0.39 in the prior art, i.e., about 17% (as represented by FY in FIG. 11). Further, on the angular side giving a lower arm level, the range of the arm rotational angle θ within which at least the blade tip force $F_E$3 is obtained is enlarged to Ed (θ3 to θ1) in this embodiment from Eb (θ3 to θ2) in the prior art, i.e., about 10%.

(3) The range of the arm rotational angle θ is enlarged to E2 in this embodiment from E0 in the prior art. The working angular range is widened particularly on the side giving a higher arm level to improve a biting ability of the bucket.

Figure 12:
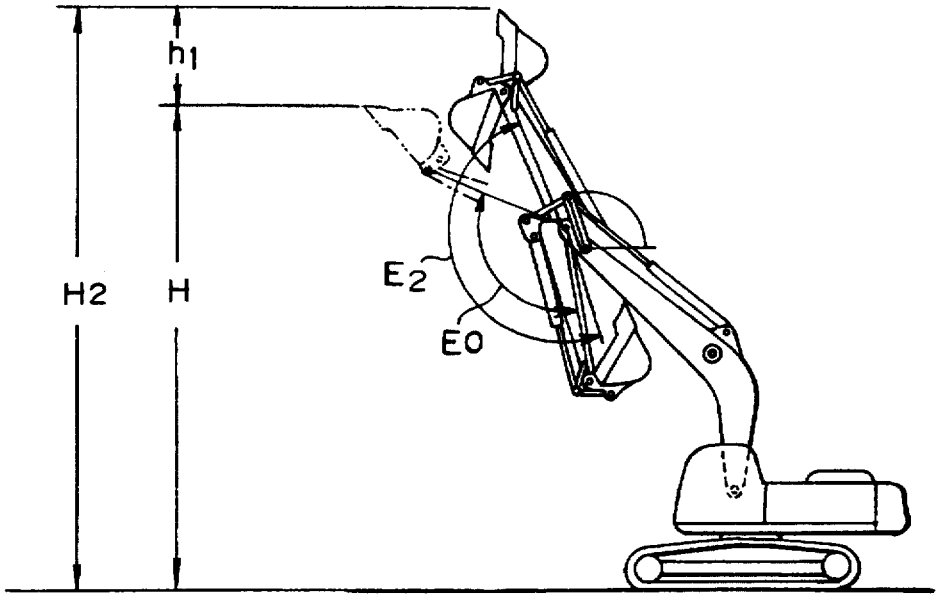
FIG. 12 is a view for explaining a working range of the hydraulic backhoe equipped with the working machine of the second embodiment.

As will be apparent from the above (1) to (3), in this embodiment, the blade tip force at the start of excavation is increased about 45% to $F_E$5 from $F_E$1 in the prior art and a reduction in the blade tip force from the maximum $F_{Emax}$ to that at the end of excavation ($F_E$6) is smaller than in the prior art. Stated otherwise, this embodiment gives much importance to increasing the blade tip force on the angular side giving a higher arm level and enlarging the working range of the arm. Consequently, as shown in FIG. 12, the working range is improved to provide a maximum working height $H_2$ larger than in the prior art (H) by $h_1$, which results in higher working efficiency.

Next, a third embodiment of the working machine of the hydraulic backhoe according to the present invention will be described with reference to FIGS. 13 to 15.

Figure 13:
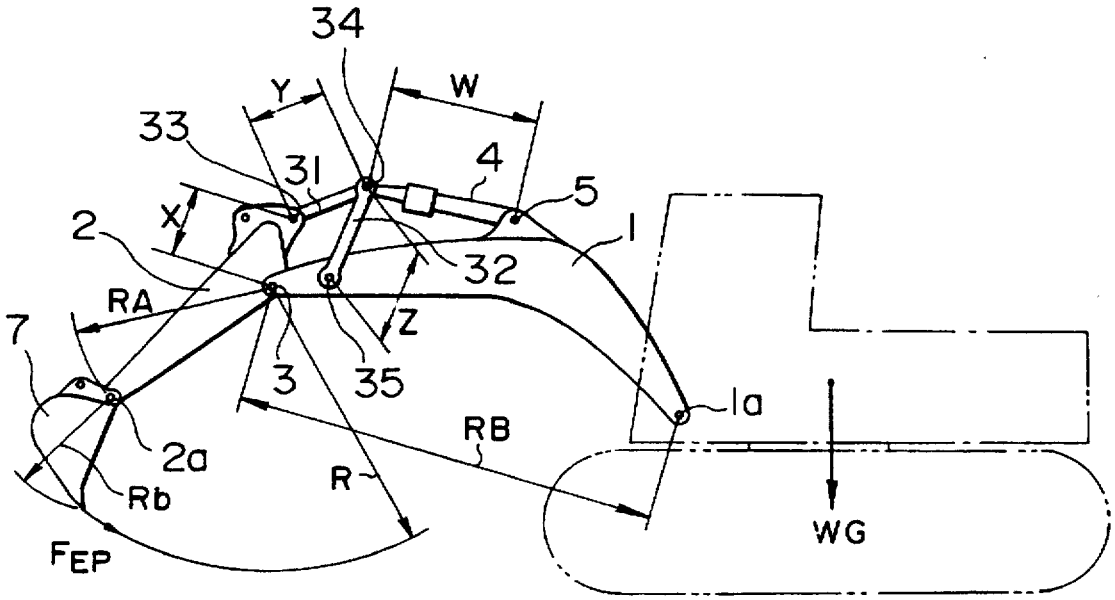
FIG. 13 is a schematic explanatory view of a working machine of a hydraulic backhoe according to a third embodiment of the present invention.
Figure 14:
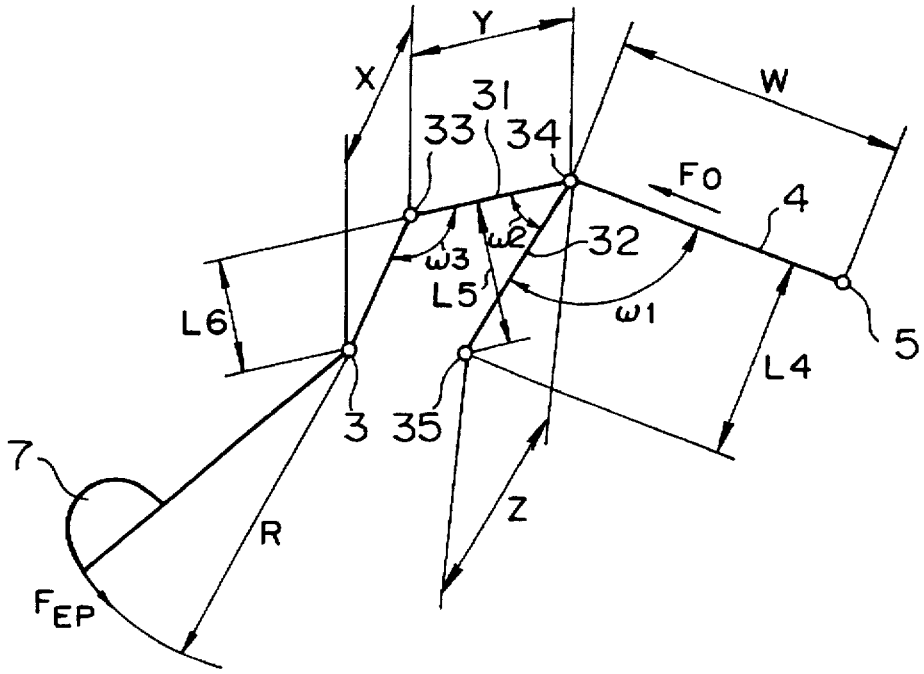
FIG. 14 is a schematic view for explaining the blade tip force of the working machines of the third embodiment.
Figure 19:
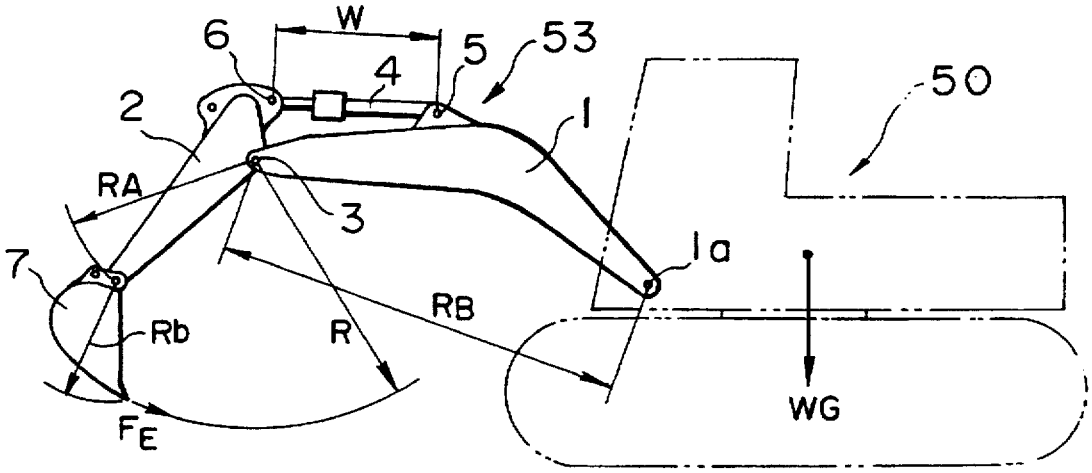
FIG. 19 PRIOR ART
FIG. 19 is an explanatory view of the working machine of FIG. 18.

In FIG. 13, the basic structural dimensions, i.e., the body weight WG of the hydraulic backhoe, the length RB of a boom 1, the length RA of an arm, the length Rb from an arm leading end to a bucket blade tip, the length R from a boom leading end to the bucket blade tip, the length W of an arm cylinder 4, and the propulsion $F_O$ (see FIG. 14), are the same as those in the prior art (FIG. 19).

A description will be followed while comparing this embodiment and the prior art. First, it is assumed in FIG. 14 that the angle formed about the third fulcrum 34 between the direction toward the pin 5 and the direction toward the fourth fulcrum 35 is ω1, the angle formed about the third fulcrum 34 between the direction toward the second fulcrum 33 and the direction toward the fourth fulcrum 35 is ω2, the angle formed about the second fulcrum 33 between the direction toward the first fulcrum 3 and the direction toward the third fulcrum 35 is ω3, the length of a vertical line extending from the fourth fulcrum 35 toward the center axis of the arm cylinder 4 is L4, the length of a vertical line extending from the fourth fulcrum 35 toward the center axis of the second link 31 is L5, and the length of a vertical line extending from the first fulcrum 3 toward the center axis of the second link 31 is L6. Further, the link ratio 1:0.87:1.25 in this embodiment is expressed by 1:k1:k2. The blade tip force $F_E P$ of the bucket 7 in the above arrangement is given by:

$$F_E P = F_0 \times (L4 \times L6)/(L5 \times R) = F_0 P \times (k2 \cdot Z \cdot \sin\omega 1 \times \sin\omega 3 \cdot X)/(k2 \cdot Z \cdot \sin\omega 2 \times R) \quad (2)$$

Figure 21:
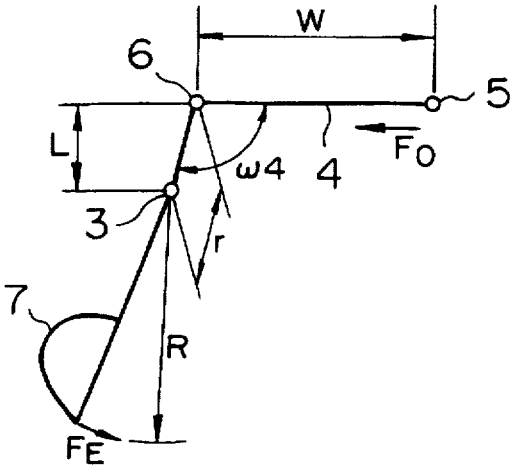
FIG. 21 PRIOR ART
FIG. 21 is a schematic view for explaining the blade tip force of the working machines of FIG. 19.

On the other hand, it is assumed in the prior art (see FIG. 21) that the angle formed about the pin 6 between the direction toward the pin 5 and the direction toward the first fulcrum 3 is ω4. Other characters are the same as those in FIG. 14. The blade tip force $F_F$ of the bucket 7 in the prior art arrangement is given by:

$$F_E = F_0 \times r \cdot \sin\omega 4/R \quad (3)$$

From the equations (2) and (3), a ratio of the blade tip force $F_E P$ in this embodiment to the blade tip force $F_E$ in the prior art is expressed by:

$$F_E P/F_E = (X \cdot \sin\omega 1 \cdot \sin\omega 3)/(r \cdot \sin\omega 4 \cdot \sin\omega 2)$$

Here, ω1, ω2, ω3, ω4 are given as functions of X, k1, k2, W. Accordingly, relative effect of the blade tip force $F_E P$ is determined by X, k1, k2, i.e., X, Y, Z, with respect to W.

Figure 15:
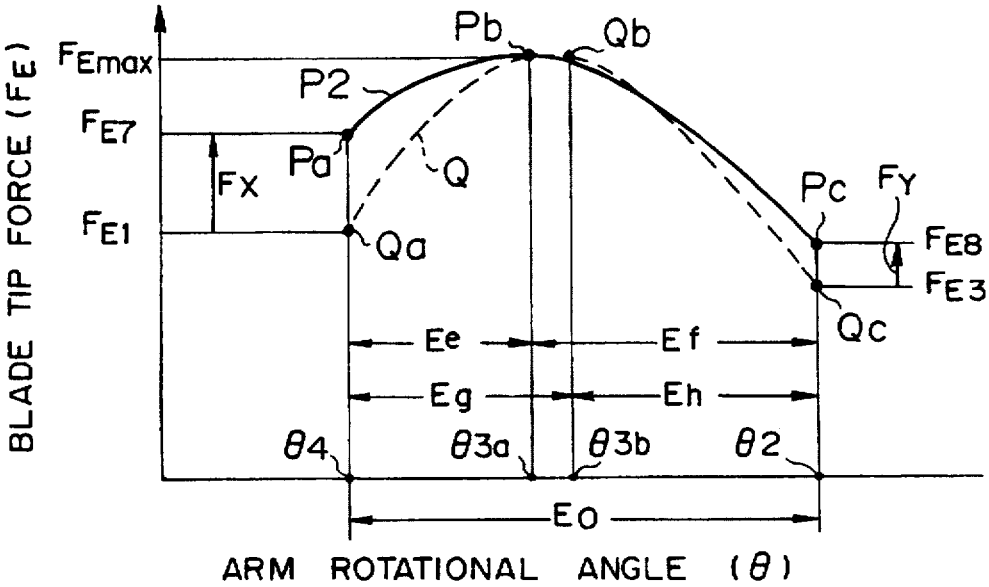
FIG. 15 is a graph showing characteristics of the blade tip forces of the working machines in the third embodiment and the prior art.

FIG. 15 shows the blade tip force $F_E P$ over a range of the arm rotational angle θ in this embodiment (represented by a curve P2). With the link ratio set to be approximately 1:0.87:1.25, this embodiment (represented by the curve P2) is improved in the following points as compared with the prior art (represented by a curve Q).

(1) Assuming that the maximum blade tip force $F_{Emax}$ (point Pb on the curve P2) is 1, the blade tip force $F_E 7$ (point Pa on the curve P2) at θ4, i.e., at the start of excavation, is 0.8. On the other hand, in the prior art, assuming that the maximum blade tip force $F_{Emax}$(point Qb on the curve Q) is 1, the blade tip force $F_E 1$ (point Qa) at the start of excavation is 0.65. Thus, the blade tip force at the start of excavation in this embodiment is increased to 0.8 from 0.65 in the prior art, i.e., about 20% (as represented by FX in FIG. 15).

(2) Assuming that the maximum blade tip force $F_{Emax}$ is 1, the blade tip force $F_E 8$ (point Pc on the curve P2) at the end of excavation is 0.54. On the other hand, in the prior art, assuming that the maximum blade tip force $F_{Emax}$ is 1, the blade tip force $F_E 3$ (point Qc) at the end of excavation is 0.5. Thus, the blade tip force at the end of excavation in this embodiment is increased to 0.54 from 0.5 in the prior art, i.e., about 10% (as represented by FY in FIG. 15).

(3) The entire range of the arm rotational angle θ remains the same as E0 in the prior art, but respective ranges on the side giving a higher arm level and on the side giving a lower arm level are different from those in the prior art with the arm rotational angle θ corresponding to the maximum blade tip force $F_{Emax}$ as a reference point. Specifically, the two ranges are Eg (θ3*b* to θ4) and Eh (θ3*b* to θ2) in the prior art, whereas the two ranges are Ee (θ3*a* to θ4) and Ef (θ3*a* to θ2) in this embodiment. Thus, this embodiment gives much importance to the blade tip force on the side giving a higher arm level. In addition, as explained above, this embodiment is arranged to prevent the blade tip force from lowering abruptly.

As will be apparent from the above (1) to (3), in this embodiment, the blade tip force at the start of excavation is increased about 45% to $F_E 7$ from $F_E 1$ in the prior art and at the end of excavation that is 10% larger than in the prior art. Stated otherwise, this embodiment intends to increase the blade tip force on the angular side giving a higher arm level and to prevent the blade tip force from lowering abruptly at the end of excavation.

Next, a fourth embodiment of the working machine of the hydraulic backhoe according to the present invention will be described with reference to the drawings.

Figure 16A:
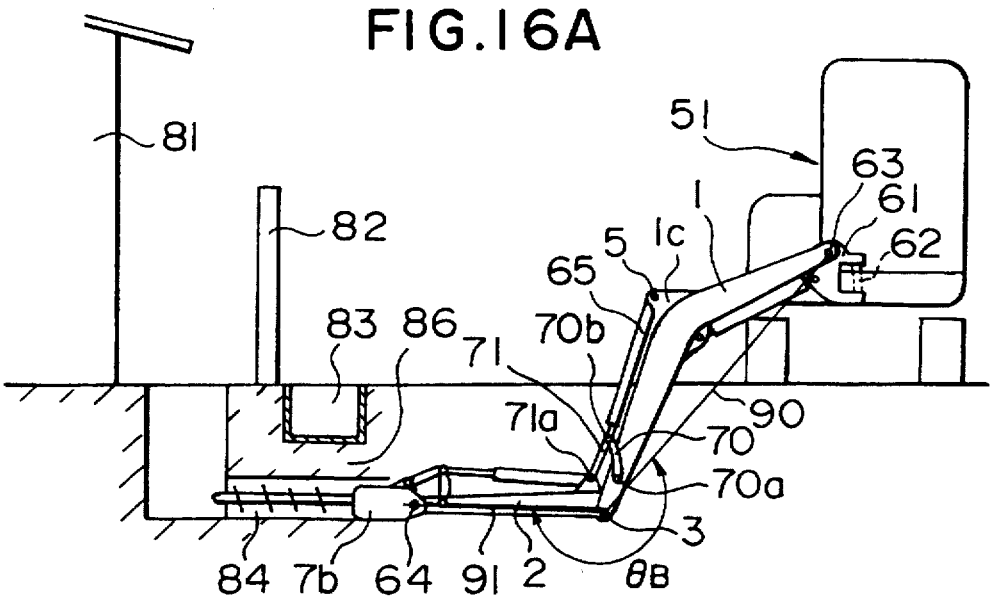
FIG. 16A is an explanatory view of a working machine of a hydraulic backhoe according to a third embodiment of the present invention.
Figure 16B:
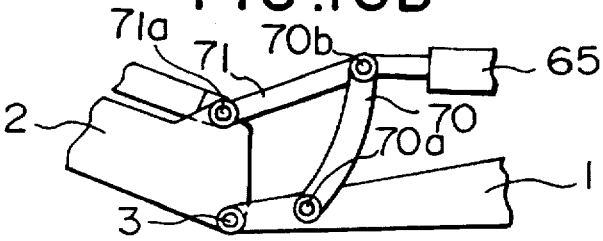
FIG. 16B is a detailed view of a 4-articulated-link mechanism in FIG. 16A.
Figure 24:
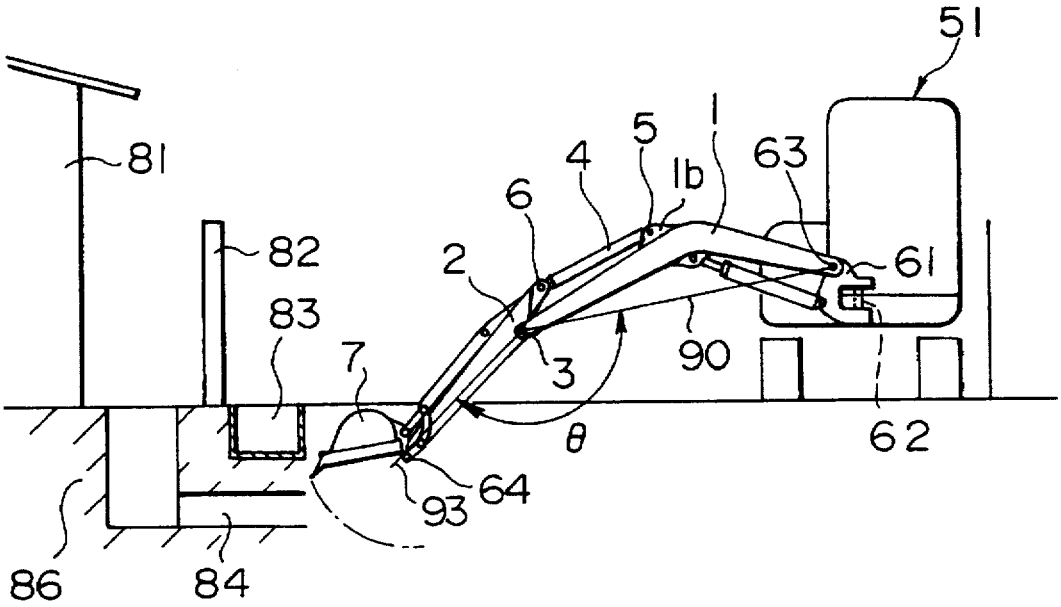
FIG. 24 PRIOR ART
FIG. 24 is an explanatory view showing one example of working state of a prior art hydraulic back hoe.
Figure 25:
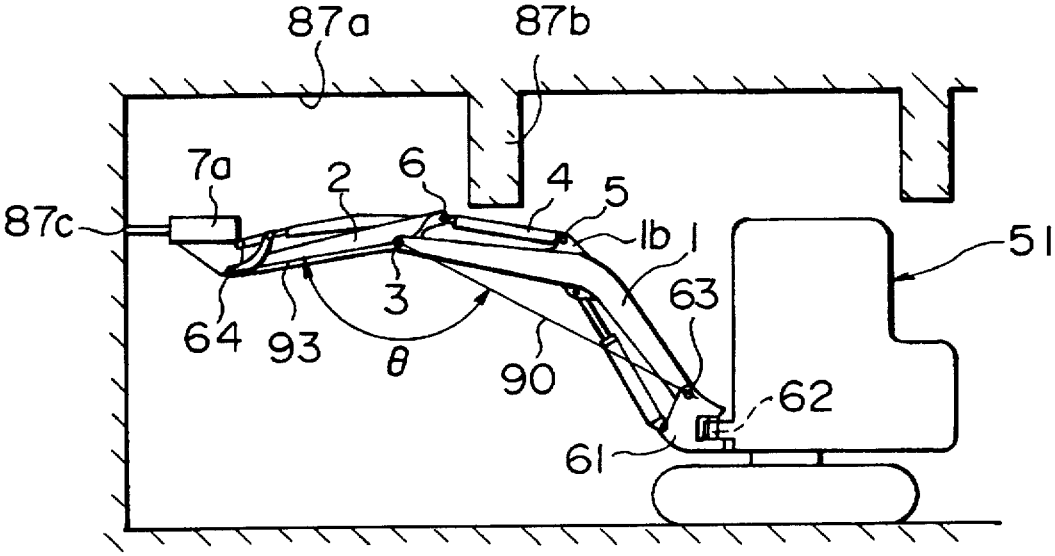
FIG. 25 PRIOR ART
FIG. 25 is an explanatory view showing another example of working state other than that shown in FIG. 24.

In FIGS. 16A and 16B, a rotary digging drill (working machine) 7*b* is attached to a leading end of an arm 2 through a pin 64. A bracket 1*c* of a boom 1 is fixed to the bracket at a position nearer to a vehicle body 51 than the bracket 1*b*(see FIG. 24) in the prior art, and a tailing end of an arm cylinder 65 is attached to a pin 5. The arm cylinder 65 has a maximum stroke longer than the arm cylinder 4 (see FIG. 24) in the prior art. In other words, the arm cylinder 65 has such a stroke as enabling the arm to rotate over a range in which a later-described arm rotational angle θB is not more than 270°.

Also, the boom 1 has a leading end pivotally attached to one end of the arm 2 through a pin 3 as a first fulcrum, and a tailing end attached to a bracket 61 through a pin 63. Further, the boom 1 is coupled to one end of a first link 70 through a pin 70*a* as a fourth fulcrum at a position nearer to the vehicle body 51 than the pin 3. Another end of the arm 2 on the same side as but different from the pin 3 (first fulcrum) is pivotally coupled to one end of a second link 71 through a pin 71*a* as a second fulcrum. The other end of the second link 71 and the other end of the first link 70 are coupled to a leading end of the arm cylinder 65 through a pin 70*b* as a third fulcrum. The tailing end of the arm cylinder 65 is pivotally coupled to the boom 1 through the pin 5. With such an arrangement, the arm 2 and the boom 1 are coupled to each other by a 4-articulated-link mechanism. Accordingly, when the arm cylinder 65 is operated to extend and contract, the arm 2 is rotated through the second link 71 and the first link 70.

In the above arrangement, an angle formed between a line 90 interconnecting the pin 63 and the pin 3, as a reference line, and a line 91 interconnecting the pin 3 and the pin 64, i.e., an arm rotational angle θB, is set to be not less than 180° in the clockwise direction from the reference line 90. Also, the arm rotational angle θB through which the arm is rotatable about the pin 3 as a fulcrum is set to be not more than 270°. As a result, in waterworks or the like, the arm 2 can be turned upwardly to avoid interference with obstacles such as a fence 82 and a gutter 83, and hence to dig a pipe burying hole 84 in the underground 86 in a satisfactory manner.

Next, a fifth embodiment of the working machine of the hydraulic backhoe according to the present invention will be described with reference to the drawings. This embodiment is adapted to carry out different work from that for the above fourth embodiment.

Figure 17:
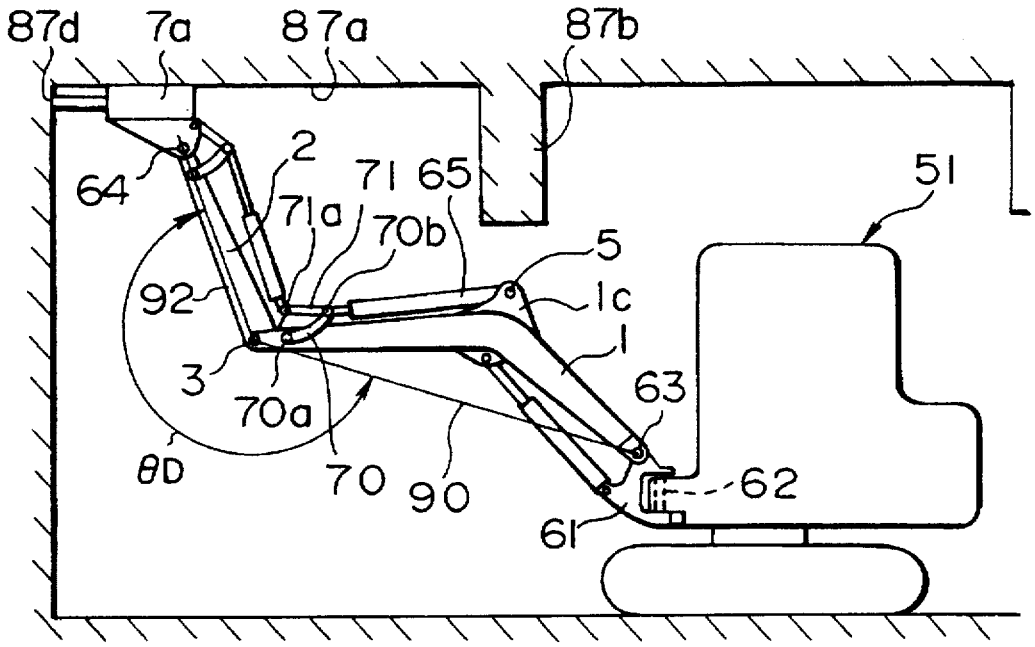
FIG. 17 is an explanatory view of a working machine of a hydraulic backhoe according to a fifth embodiment of the present invention.
Figure 18:
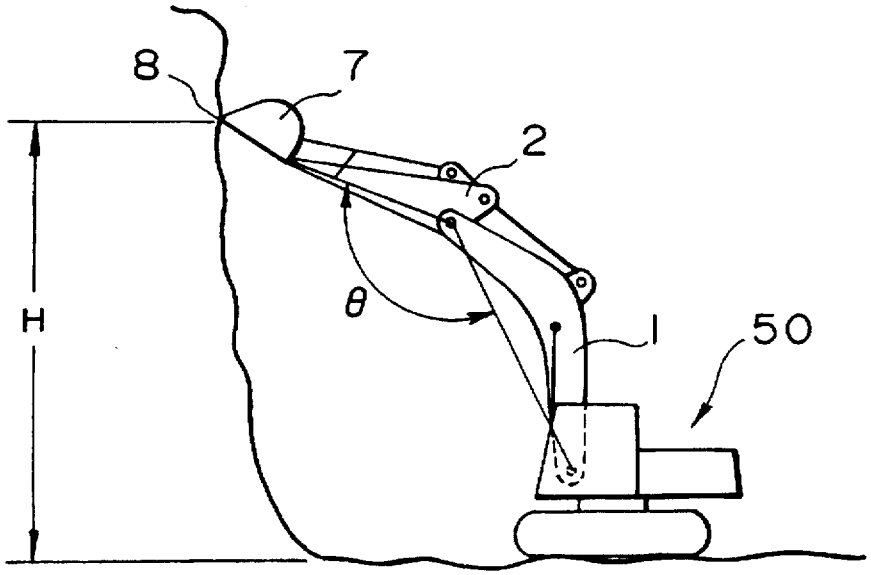
FIG. 18 PRIOR ART
FIG. 18 is an explanatory view showing a hydraulic backhoe according to one prior art which is in digging work at an upper level.

In FIG. 17, a breaker 7*a* is attached to the leading end of the arm 2 through a pin 64. The remaining construction of the working machine is the same as in FIG. 16. An angle (arm rotational angle θD) formed between the line 90 interconnecting the pin 63 and the pin 3, as a reference line, and a line 92 interconnecting the pin 3 and the breaker 7*a* is set to be not less than 180° in the clockwise direction from the reference line 90 as with the fourth embodiment. Also, the arm rotational angle θD through which the arm is rotatable about the pin 3, as a fulcrum, for coupling the leading end of the boom 1 to the arm 2 is set to be not more than 270° as with the fourth embodiment.

With such an arrangement, when pulling down an office building or the like, the arm 2 can be turned upwardly to avoid interference with obstacles such as a pillar beam 87*b*, and hence to break up a wall 87*d* near a ceiling 87*a*. As a result, even when there is an overhead obstacle suspended within the building in front of the vehicle body, it is possible to easily perform the pull-down work of a wall, etc. standing above a suspended end of the overhead obstacle while avoiding interference with the obstacle, and to improve the working efficiency.

INDUSTRIAL APPLICABILITY

According to the present invention, a practically useful working machine of a hydraulic backhoe is achieved which can not only increase the blade tip force of a bucket over an entire working range, but also enlarge the working range, which has a great blade tip force at the start of excavation, and which can allow the arm to turn upwardly for an improvement in working efficiency.

We claim:

1. A working machine of a hydraulic backhoe, comprising:

boom attached to a bracket on a vehicle body;

an arm coupled to a first fulcrum at a leading end of said boom;

a first link having one end coupled to said boom and another end coupled to an arm cylinder, said one end of said first link and said another end of said first link being opposing of said first link;

a second link having one end coupled to a second fulcrum provided on one side of said arm and the other end coupled to the another end of said first link; and a working member coupled to another end of said arm, wherein one end of said first link is coupled to either the leading end of said boom or a portion of said boom on a rear side of a leading end, and said second link is a hydraulic correction cylinder.

wherein a first coupling position which is between said first link and said second link is proximate a second coupling which is between said first link and said arm cylinder, a third coupling position being between said first link and said boom, and wherein a first distance between said first coupling position and said third coupling position is less than or equal to a second distance between said second coupling position and said third coupling position.

2. A working machine of a hydraulic backhoe according to claim 1, wherein a working hydraulic circuit for said arm cylinder and said correction cylinder constitutes a series circuit having a circuit connecting a head side oil chamber of said arm cylinder to a bottom side oil chamber of said correction cylinder.

3. A working machine of a hydraulic backhoe according to claim 1 or 2, wherein a third fulcrum at which the other end of said first link and said arm cylinder are coupled to each other comprises a fulcrum at which said arm cylinder and said first link are coupled to each other and a fulcrum at which said correction cylinder and said first link are coupled to each other, wherein (a) said fulcrum at which said arm cylinder and said first link are coupled to each other and (b) said fulcrum at which said correction cylinder and said first link are coupled to each other are spaced apart by a predetermined distance.

4. A working machine of a hydraulic backhoe, comprising:

a boom attached to a bracket on a vehicle body;

an arm coupled to a first fulcrum at a leading end of said boom;

a first link having one end coupled to said boom and another end coupled to an arm cylinder, said one end of said first link and said another end of said first link being on opposing ends of said first link;

a second link having one end coupled to a second fulcrum provided on one side of said arm and the other end coupled to the another end of said first link; and a working member coupled to another end of said arm, wherein a ratio of the fulcrum-to-fulcrum distance between said first fulcrum and said second fulcrum, the pivot-to-pivot distance along a center axis of said second link, and the pivot-to-pivot distance along a center axis of said first link is approximately 2:2:3.

5. A working machine of a hydraulic backhoe, comprising:

a boom attached to a bracket on a vehicle body;

an arm coupled to a first fulcrum at a leading end of said boom;

a first link having one end coupled to said boom and another end coupled to an arm cylinder, said one end of said first link and said another end of said first link being on opposing ends of said first link;

a second link having one end coupled to a second fulcrum provided on one side of said arm and the other end coupled to the another end of said first link; and a working member coupled to another end of said arm, wherein a ratio of the fulcrum-to-fulcrum distance between said first fulcrum and said second fulcrum, the pivot-to-pivot distance along a center axis of said second link, and the pivot-to-pivot distance along a center axis of said second link, and the pivot-to-pivot distance along a center axis of said first link is approximately 1:0.87:1.25.

6. A working machine of a hydraulic backhoe, comprising:

a boom attached to a bracket on a vehicle body;

an arm coupled to a first fulcrum at a leading end of said boom;

a first link having one end coupled to said boom and another end coupled to an arm cylinder, said one end of said first link and said another end of said first link being on opposing ends of said first link;

a second link having one end coupled to a second fulcrum provided on one side of said arm and the other end coupled to the another end of said first link; and a working member coupled to another end of said arm, wherein an arm rotational angle formed between a first line interconnecting a pivot pin for coupling said boom to said bracket on the vehicle body and said first fulcrum, as a reference line, and a second line interconnecting said first fulcrum and a pivot pin for coupling said working member to said arm is set to be at least 180° in the clockwise direction from said first line to said second line.

7. A working machine of a hydraulic backhoe according to claim 6, wherein the arm rotational angle through which said arm is rotatable about a pivot pin, as a fulcrum, for coupling the leading end of said boom to said arm is set to be not more than 270°.

* * * * *